United States Patent [19]

Barbagli

[11] Patent Number: 4,508,013

[45] Date of Patent: Apr. 2, 1985

[54] REMOTE CONTROLLED HYDRAULIC CIRCUIT HAVING SELECTOR MEANS FOR ESTABLISHING PRIORITY THEREIN

[75] Inventor: Rino O. Barbagli, Borgaretto, Italy

[73] Assignee: Fiatallis Europe, S.p.A., Lecce, Italy

[21] Appl. No.: 489,051

[22] Filed: Apr. 27, 1983

[30] Foreign Application Priority Data

Jun. 14, 1982 [IT] Italy ..... 67764 A/82

[51] Int. Cl.[3] ..... F15B 11/00

[52] U.S. Cl. ..... 91/516; 91/517; 91/518; 91/529; 414/699

[58] Field of Search ..... 91/516, 517, 518, 532, 91/527, 528, 529; 60/422; 414/697, 699; 137/112, 114

[56] References Cited

U.S. PATENT DOCUMENTS

| | | | |
|---|---|---|---|
| 2,892,311 | 6/1959 | Van Gerpen | 60/422 |
| 3,978,998 | 9/1976 | Klitz | 91/516 X |
| 3,991,571 | 11/1976 | Johnson | 60/422 |
| 4,286,692 | 9/1981 | Bauer et al. | 91/518 X |
| 4,343,151 | 8/1982 | Lorimor | 91/516 X |
| 4,369,625 | 1/1983 | Izumi et al. | 60/422 X |
| 4,372,193 | 2/1983 | Hall | 91/516 X |

*Primary Examiner*—Robert E. Garrett
*Assistant Examiner*—Timothy E. Nauman
*Attorney, Agent, or Firm*—Robert A. Brown

[57] ABSTRACT

A remote controlled hydraulic circuit of the type comprising a source of pressurized fluid, a number of hydraulic motors connectible to the source of pressurized fluid, and control means for connecting the source of pressurized fluid to the hydraulic motors, the control means being remotely piloted by a series of pressure signals each of which corresponds to the opening of the connection between the source of pressurized fluid and a respective hydraulic motor. The hydraulic circuit according to the invention includes selector means for establishing priority for supplying pressurized fluid to one or more preferential hydraulic motors. These selector means are intended to detect, when operatively active, pressure signals corresponding to the supply of pressurized fluid to the preferential hydraulic motors and, in this condition, to render inoperative the control means associated with the other hydraulic motors, should they already have been activated to effect the supply of these other hydraulic motors.

The hydraulic circuit according to the invention is used, for example, in the control of a lifting arm or boom for the bucket of an earth-moving machine so as to ensure return movement of the bucket when the latter is operated simultaneously with or at the same time as the movement of the lifting arm.

3 Claims, 3 Drawing Figures

REMOTE CONTROLLED HYDRAULIC CIRCUIT HAVING SELECTOR MEANS FOR ESTABLISHING PRIORITY THEREIN

BACKGROUND OF THE INVENTION

The present invention relates generally to earth moving machinery and more particularly to a hydraulic circuit of the type comprising:

a source of pressurized fluid;

a plurality of hydraulic motors connectible to the source of pressurized fluid, and control means for connecting the source of pressurized fluid to the hydraulic motors, the control means being remotely piloted by a series of pressure signals each of which corresponds to the opening of the connection between the source of pressurized fluid and a respective hydraulic motor.

In the operation of construction machinery vehicles there are utilized hydraulic logic control systems including sensor means to detect relative lift arm and bucket positions and effect control thereof during various modes of operation. In this connection, the systems provide for establishing priority supplying pressurized fluid to one or more predetermined hydraulic motors by selectively detecting pressure signals corresponding to the supply of pressurized fluid to the predetermined hydraulic motors and, in this condition, to render inoperative control means associated with other hydraulic motors in the system, in the event they have already been activated and could affect the supply of fluid to the other hydraulic motors.

Illustrations depicting the manner in which various solutions have been attempted to solve existing problems may be found in U.S. Pat. Nos. 3,429,471; 3,519,155; 3,630,121; 3,659,734; 3,887,098.

SUMMARY OF THE INVENTION

Accordingly, it is an object of the present invention to provide a hydraulic logic circuit that does not have the disadvantages of the prior art and thus utilizes selector means for the priority supply of pressurized fluid to one or more preferential hydraulic motors, the selector means being intended to detect, when they are active, the pressure signals corresponding to the supply of pressurized fluid to the preferential hydraulic motors and, in this condition, to render inoperative the control means associated with the other hydraulic motors, should they have already been activated to effect the supply of the other hydraulic motors.

Another object of this invention is to provide selector means that includes a main selector valve having a first inlet which, when at least one of the pressure signals corresponding to the supply of pressurized fluid to the preferential hydraulic motors is active, receives this pressure signal;

a second inlet which, when at least one of the pressure signals to the non-preferential hydraulic motors is active, receives this pressure signal;

an outlet which is supplied with pressurized fluid when the first inlet and the second inlet receive a pressure signal, and actuator means which is activated by the pressurized fluid from the outlet.

A further object of this invention is to provide selector means that includes a first outlet communicating with a drain tank, and a second outlet connected to the control means associated with the non-preferential hydraulic motors. Moreover, the actuator means comprises a distributor valve that puts the first outlet into communication with the second outlet when the outlet of the main selector valve is supplied with pressurized fluid.

The hydraulic circuit according to the invention is particularly applicable in the case where the hydraulic motors comprise head and rod end chambers of two double-acting hydraulic jacks used for controlling the lifting arm or boom and bucket of an earth-moving machine. In this case, the control means for connecting the source of pressurized fluid to the chambers of the two hydraulic jacks comprise two hydraulic distributor valves each having a neutral central position and two operative end positions corresponding to the supply of pressurized fluid to the two chambers of the respective hydraulic jack. In this case, moreover, the hydraulic circuit includes four pilot valves, each of which, when activated, supplies at its outlet a pressure signal that is sent to a respective hydraulic distributor valve to control its movement towards one of its two operative end positions.

In this type of application, the hydraulic circuit according to the invention is further characterized in that the first inlet of the main selector valve is connected to the outlet of the pilot valve responsible for the return of the bucket, and in that the second inlet is connected to the two outlets of the pilot valves responsible for the operation of the lifting arm by means of an auxiliary selector valve.

BRIEF DESCRIPTION OF THE DRAWINGS

The foregoing and other characteristics, objects, features and advantages of the present invention will become more apparent upon consideration of the following description, having reference to the accompanying drawings supplied purely by way of non-limiting example, wherein.

DESCRIPTION OF A PREFERRED EMBODIMENT OF THE INVENTION

Figures 1, 2:
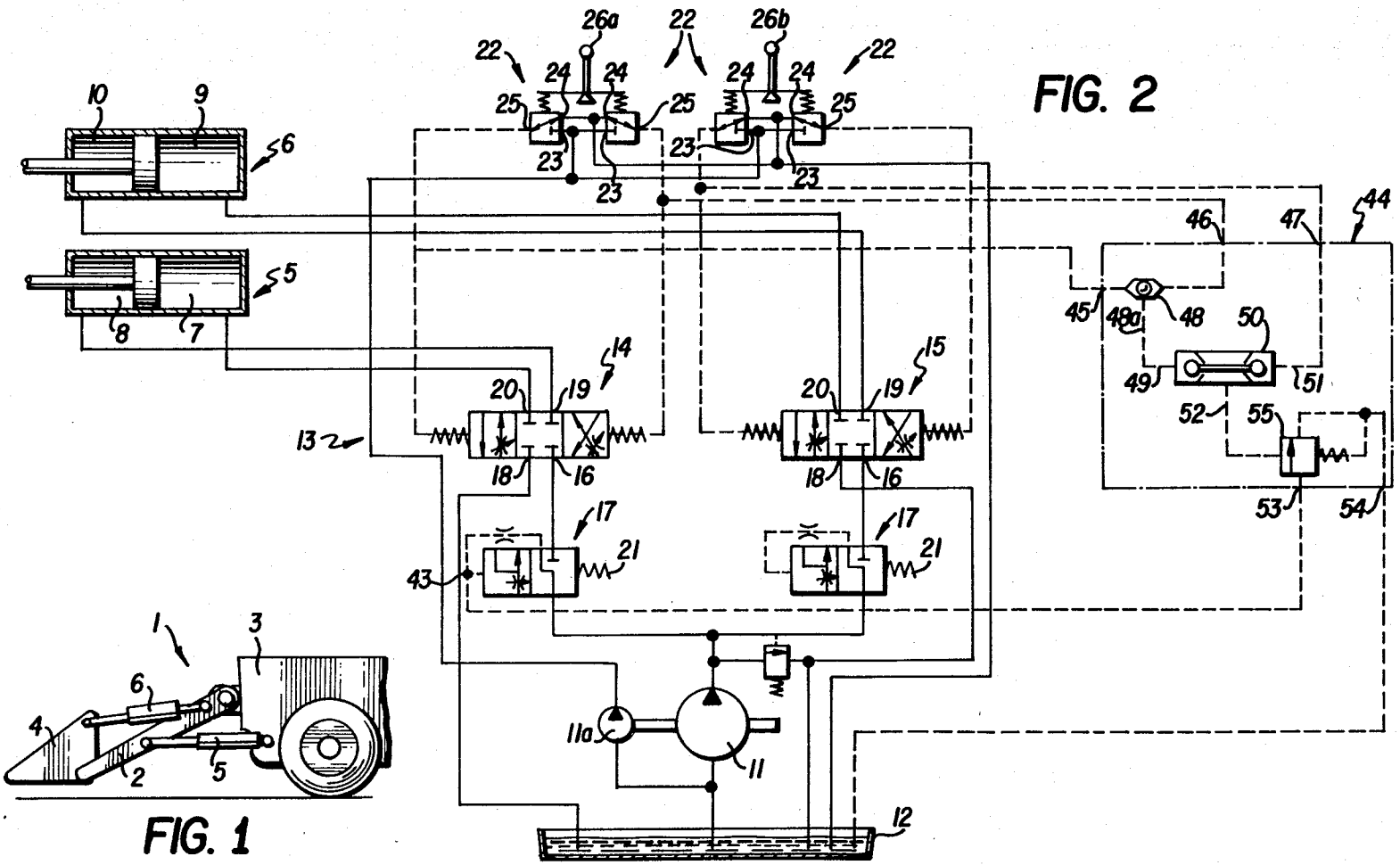
FIG. 1 shows diagrammatically the lifting arm, bucket, and related hydraulic control jacks of an earth-moving machine.
FIG. 2 shows the diagram of a hydraulic circuit according to the present invention, for supplying the hydraulic jacks which control the lifting arm and the bucket of an earth-moving machine.

In FIG. 1, there is shown, generally indicated by the reference numeral 1, an earth-moving machine including a lifting arm or boom 2 articulately connected to the frame 3 of the earth-moving machine, and a bucket 4 pivotally connected to the free end of the arm 2. The reference numerals 5, 6 indicate respectively two double-acting hydraulic jacks for controlling the lifting arm 2 and the bucket 4.

FIG. 2 illustrates a simplified diagram of the hydraulic circuit which controls the supply of pressurized fluid to the chambers of the two double-acting hydraulic jacks 5, 6. As will be apparent from the following description, the hydraulic circuit shown in FIG. 2 is arranged so that, when the arm 2 is moved upwardly or downwardly and there is a simultaneous return of movement of the bucket 4 (or a rotation of the bucket in the clockwise direction referring to FIG. 1), the supply of pressurized fluid to the hydraulic jack 5 controlling the lifting arm 2 is cut off, thus ensuring that the pressurized fluid will reach the jack controlling the bucket 4. In the opposite case, it could happen that the return movement of the bucket does not take place, because all the pressurized fluid flows into the control jack of the arm 2 wherein it would meet a smaller resistance.

In FIG. 2, the reference numerals 7, 8 and 9, 10 indicate respectively the chambers of the two double-acting hydraulic jacks 5, 6 which control the lifting arm 2 and the bucket 4 of the earth-moving machine.

The hydraulic circuit illustrated in FIG. 2 includes a source of pressurized fluid that comprises a pump 11 with an inlet connected to a tank 12 and an outlet connected to the chambers 7, 8 and 9, 10 of the two hydraulic jacks 5, 6 by control means, generally indicated by the reference numeral 13.

The control means 13 comprises two hydraulic distributor valves 14, 15 associated with the hydraulic jacks 5, 6 respectively.

Each hydraulic distributor valve includes a first inlet 16 connected to the outlet of the pump 11 through an ancillary valve 17 (which will be described in detail below), a second inlet 18 connected to the drain tank 12, and two outlets 19, 20 connected to the respective chambers of the corresponding double-acting hydraulic jack. Each hydraulic distributor valve is also provided with a reciprocally movable distributor valve spool which has a neutral central position corresponding to the interruption of the connection between the two inlets 16, 18 and the outlets 19, 20, and two operative end positions. In one of these operative end positions, the inlet 16 is connected to the outlet 19 and the inlet 18 is connected to the outlet 20. In this condition, the pressurized fluid is supplied to one of the two chambers of the corresponding hydraulic jack, while the other chamber drains into the tank 12. In the other operative end position, these connections are reversed.

At the ends of the distributor valve spool of each hydraulic distributor valve are two springs 21 which tend to keep the distributor valve spool in its neutral central position. The distributor valve spool is displaced from this central neutral position to one or other of the operative end positions by the sending of a pressure signal to each end of the distributor valve spool. For this purpose, the hydraulic circuit includes four pilot valves 22 each of which has a first inlet 23 connected to the outlet of an auxiliary supply pump 11*a* (the inlet of which is connected to the tank 12), a second inlet 24 connected to the tank 12, and an outlet 25 connected to a respective end chamber of one of the two hydraulic distributor valves. Each of the pilot valves 22 has an inoperative position in which the outlet 25 is connected to the inlet 24, so that the respective end chamber of the hydraulic distributor valve associated therewith will be connected to the drain tank 12, and an operative position in which the outlet 25 is connected to the first inlet 23, so that the pressurized fluid is supplied to the end chamber to cause a displacement of the distributor valve spool towards the opposite end.

The four spool valves 22 are controlled in pairs by two manual control levers 26*a*, 26*b* each having two operative positions corresponding respectively to the activation of the two pilot valves 22 associated therewith. In one variant, known in itself, the pilot valves 22 are controlled by a single lever which moves in two mutually perpendicular planes.

Figure 3:
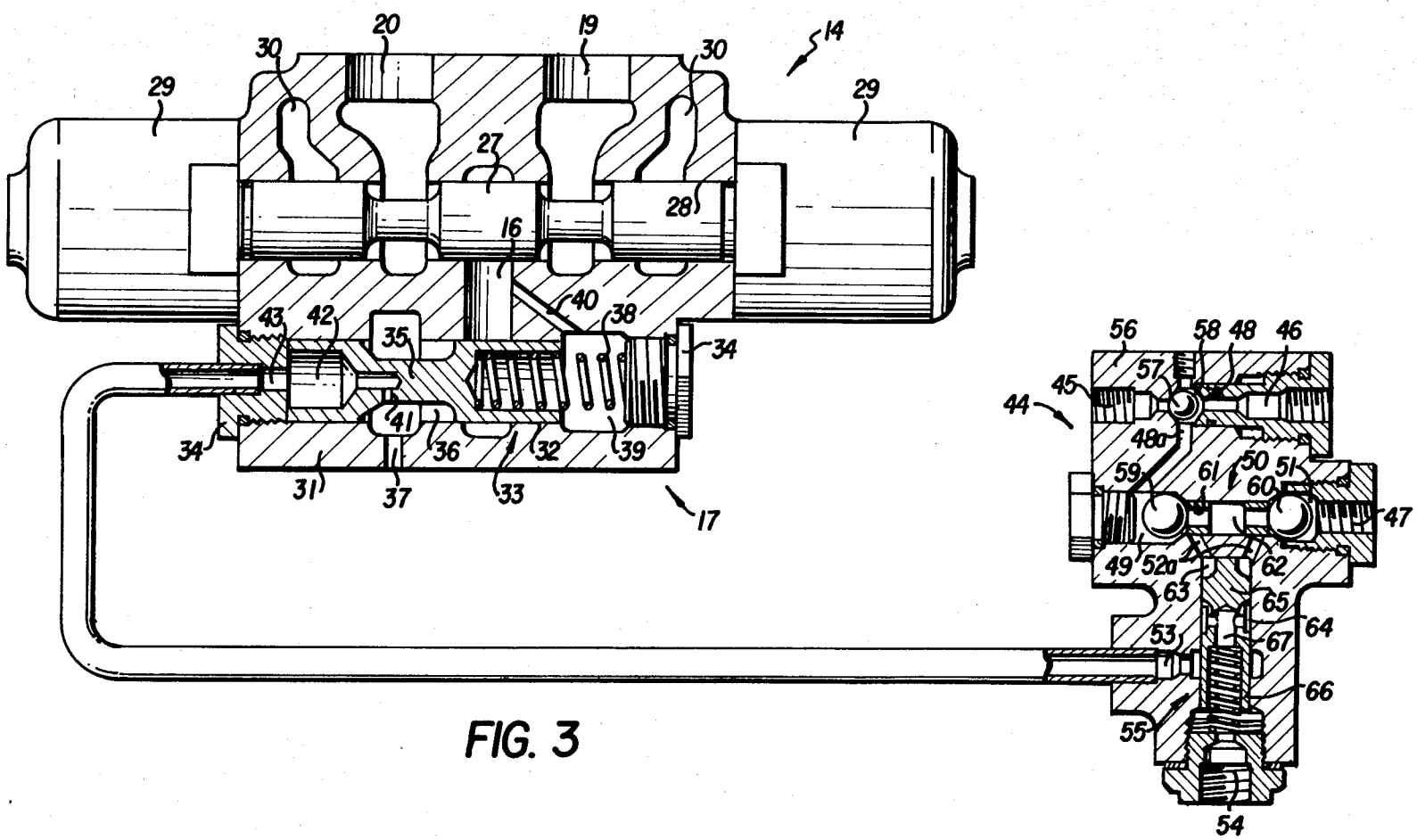
FIG. 3 shows a preferred embodiment of one detail of the hydraulic circuit of FIG. 2.

FIG. 3 shows a preferred embodiment (of a type known in itself) of the hydraulic distributor valve 14. Referring to FIG. 3, the distributor valve spool (shown as 27) is assembled slidably in a cavity 28 of the distributor body. The reference numerals 29 show two end portions of the distributor body in which are formed the two end chambers housing the two springs 21 and communicating respectively with the outlets 25 of the two pilot valves 22 connected to the distributor valve. Two chambers 30 are connected to the drain tank 12 through the inlet 18 (not seen in FIG. 3). When, as a result of the activation of one of the two pilot valves 22 connected to the hydraulic distributor valve, the distributor valve spool 27 moves from its central neutral position (shown in FIG. 3) to the left or the right (referring to FIG. 3) towards one of its operative end positions, the pressurized fluid supplied to the inlet 16 flows into one of the two outlets 19, 20 while the other outlet will be connected to one of the two exhaust chambers 30.

FIG. 3 also shows the structure of the ancillary valve 17. This valve comprises a body 31 in which is formed a cylindrical cavity 32 having an axis parallel to the axis of the distributor valve 27. A piston 33 is slidably housed within the cylindrical cavity 32. The ends of the cylindrical cavity 32 are closed by two plugs 34. The piston 33 has a reduced diameter portion 35 which defines an annular chamber 36 communicating with the outlet of the pump 11 through an inlet 37. A spring 38 urges the piston 35 into a position in which the connection between the chamber 36 and the inlet 16 of the hydraulic distributor is cut off. The chamber 39 adjacent the right-hand end of the piston 33 (with reference to FIG. 3) is connected to the drain tank through a hole 40. The piston 33 also has a narrow passage 41 for connecting the chamber 36 with a chamber 42 that communicates with an outlet 43. The outlet 43 is connected to a selector unit 44 which is described in detail below. When pressurized fluid is supplied from the pump 11 to the chamber 36 it thrusts the piston 33 to the right (with reference to FIG. 3), against the action of the spring 38, until it is carried into a position in which it allows the inlet 16 of the hydraulic distributor valve to be supplied.

This is due to the fact that the fluid enters the chamber 42 through the hole 41 and thrusts the piston 33 to the right.

As shown diagrammatically in FIG. 2, the selector unit 44 has two inlets 45, 46 which are connected to the outlets 25 of the two pilot valves 22 associated with the hydraulic distributor valve 14 for actuating the cylinder 5 which controls the lifting arm, and a third inlet 47 connected to the outlet 25 of the pilot valve 22 which controls the return of the bucket. The two inlets 45, 46 are connected to an inlet 49 of a main selector valve 50 through an auxiliary selector valve 48. The inlet 47, on the other hand, communicates with the other inlet 51 of the main selector valve 50.

The auxiliary selector valve 48 and the main selector valve 50 function according to an "OR" and an "AND" logic, respectively. In other words, the valve 48 provides a pressure signal at its outlet 48*a* when it receives a pressure signal at either one of its two inlets 45, 46. The valve 50 provides a pressure signal at its outlet 52 when it receives a pressure signal at both its inlets 49, 51.

The selector unit includes, finally, a valve 55 which puts two outlets 53, 54 into communication when it receives pressurized fluid from the outlet 52 of the main selector valve 50. The outlet 53 is connected to the outlet 43 of the ancillary valve 17 associated with the hydraulic distributor valve 14, and the outlet 54 is connected to the drain tank 12.

FIG. 3 shows a preferred embodiment of the selector unit 44. In FIG. 3, the parts corresponding to those shown diagrammatically in FIG. 2 are indicated by the same reference numerals. The reference numeral 56 indicates the body of the selector unit, in which the three inlets 45, 46, 47 and the two outlets 53, 54 are located. In a known manner, the auxiliary selector valve 48 comprises a ball 57 in a chamber 58 which communicates with the two inlets 45, 46. When pressurized fluid is supplied to one of the two inlets 45, 46, the ball 57 cuts off the communication between the chamber 58 and the other inlet to allow the flow of pressurized fluid to the outlet 48*a*.

The selector valve 50 includes two balls 59, 60 which control respectively the communication between the inlets 49, 51 and a cylindrical cavity 61 in which a spacer member 62 is slidingly assembled between the balls 59, 60. The cavity 61 communicates with two conduits or pipes 52*a* (corresponding to the outlet 52 shown diagrammatically in FIG. 2). The conduits 52*a* open into a chamber 63 defined within a cavity 64 by one end of a slidable piston 65 (constituting the moving member of the valve 55 in FIG. 2) which moves reciprocally in the cavity 64. The piston 65 is thrust towards the chamber 63 by a spring 66 which urges it into a position in which it cuts off the connection between the outlets 53, 54. When pressurized fluid is supplied to the interior of the chamber 63, the piston 65 moves downwards against the action of the spring 66 to put the two outlets 53, 54 into communication through an internal passage 67. In this condition, the inlet 43 of the ancillary valve 17 associated with the hydraulic distributor valve 14 is connected to the tank 12. The pressurized fluid which is supplied through the inlet 37 to the interior of the ancillary valve 17 is therefore exhausted into the tank 12 through the narrow passage 41, the chamber 42, and the inlet 43, and the piston 33 remains in the position in which it does not allow the hydraulic distributor valve to be supplied.

In operation, when pressurized fluid is supplied to the hydraulic jack 5 controlling the lift arm of the machine, the pressure signal which pilots the corresponding distributor valve 14 is also sent to one of the two inlets 45, 46 of the selector unit 44. The auxiliary selector valve 48 then transmits this pressure signal to the inlet 49 of the main selector valve 50. If, in this condition, a return movement of the bucket is also effected, then the corresponding pilot pressure for the distributor valve 15 is also sent to the inlets 47, 51 of the main selector valve 50. The latter, therefore, being supplied with pressurized fluid at both inlets 49, 51, allows the fluid to flow into the chamber 63 through its outlet 52. The greater of the two pressures existing in the inlets 49, 51 thrusts the corresponding ball against its seat so as to keep the other ball in the open position by means of the spacer member 62. The piston 65 thus moves into the position in which it allows communication between the outlets 53, 54, consequently causing the return of the ancillary valve 17 (see FIG. 3) to its neutral position and the deactivation of the jack 5. The latter remains deactivated as long as the bucket is being returned.

It is evident that, while the principle of the invention remains the same, the details of construction and forms of embodiment may be varied widely from what has been described and illustrated purely by way of example, without thereby departing from the scope of the present invention.

It is further evident, in fact, that the basic principle of this invention can also be applied to hydraulic circuits differing from that which has been described and illustrated, by way of example, with reference to the case of the control arm and bucket of the earth-moving machine.

Moreover, there may be as many hydraulic motors as desired and as many of these may be supplied by priority as desired. It is possible, in fact, to combine together various selector valves of the type like the valve 48, 50, in order to obtain the desired hydraulic logic control sequence.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A hydraulic circuit including:

a source of pressurized fluid;

a plurality of hydraulic motors connectible to the source of pressurized fluid, and control means for connecting the source of pressurized fluid to the hydraulic motors, the control means being remotely piloted by a series of pressure signals each of which corresponds to the opening of the connection between the source of pressurized fluid and a respective hydraulic motor, selector means for the priority supply of pressurized fluid to one or more preferential hydraulic motor chambers, the selector means being intended to detect, when they are active, the pressure signals corresponding to the supply of pressurized fluid to the preferential hydraulic motors and, in this condition, to render inoperative the control means associated with the other hydraulic motors, should they already have been activated to effect the supply of the other hydraulic motors, said selector means including a main selector valve comprising:

a first inlet which, when at least one of the pressure signals corresponding to the supply of pressurized fluid to the preferential hydraulic motors is active, receives this pressure signal;

a second inlet which, when at least one of the pressure signals corresponding to the supply of pressurized fluid into the non-preferential hydraulic motors is active, receives this pressure signal;

an outlet which is supplied with pressurized fluid when the first inlet and the second inlet receive a pressure signal, actuator means which is activated by the pressurized fluid from said outlet, a first outlet communicating with a drain tank and a second outlet connected to the control means associated with non-preferential hydraulic motors, and in that the actuator means comprises piston means that puts the first outlet into communication with the second outlet when the outlet of the main selector valve is supplied with pressurized fluid.

2. A hydraulic circuit according to claim 1, wherein the hydraulic motors include two double-acting hydraulic jacks having chambers for controlling a lifting arm and a bucket of an earth-moving machine, said control means connecting the source of pressurized fluid to the chambers of the two hydraulic jacks including two hydraulic distributor valves each having a central neutral position and two operative end positions corresponding to the supply of pressurized fluid to the two chambers of the respective hydraulic jack, and four pilot valves each of which, when activated, supplies at its outlet a pressure signal that is sent to a respective hydraulic distributor valve to control its movement into one of its two operative end positions, characterized in that the first inlet of the main selector valve is connected to the outlet of the pilot valve responsible for the bucket, and in that the second inlet is connected to the two outlets of the pilot valves responsible for the control of the lifting arm by means of an auxiliary selector valve.

3. A hydraulic circuit according to claim 2, in which there is interposed between the inlet of the hydraulic distributor valve controlling the lifting arm and the source of pressurized fluid, an ancillary valve comprising a piston which is thrust by the pressurized fluid from the source against the action of resilient means towards a position in which it allows the flow of the pressurized fluid into the hydraulic distributor valve, characterized in that the inlet of the ancillary valve communicates, through a narrow passage in the piston, with a chamber which is connected to the second outlet of the main selector valve.

* * * * *